US008979553B2

(12) United States Patent
Lloyd et al.

(10) Patent No.: US 8,979,553 B2
(45) Date of Patent: Mar. 17, 2015

(54) CONNECTOR GUIDE FOR ORIENTING WIRES FOR TERMINATION

(71) Applicant: Molex Incorporated, Lisle, IL (US)

(72) Inventors: Brian Keith Lloyd, Maumelle, AR (US); John R. Crane, Little Rock, AR (US)

(73) Assignee: Molex Incorporated, Lisle, IL (US)

( * ) Notice: Subject to any disclaimer, the term of this patent is extended or adjusted under 35 U.S.C. 154(b) by 210 days.

(21) Appl. No.: 13/660,459

(22) Filed: Oct. 25, 2012

(65) Prior Publication Data

US 2014/0120779 A1 May 1, 2014

(51) Int. Cl.

| | |
|---|---|
| ***H01R 12/00*** | (2006.01) |
| ***H01R 13/502*** | (2006.01) |
| ***H01R 12/53*** | (2011.01) |
| ***H01R 13/58*** | (2006.01) |
| *H01R 13/6463* | (2011.01) |
| *H01R 13/66* | (2006.01) |

(52) U.S. Cl.

CPC ..... *H01R 13/502* (2013.01); *H01R 12/53* (2013.01); *H01R 13/5804* (2013.01); *H01R 13/6463* (2013.01); *H01R 13/6658* (2013.01)

USPC ..... 439/76.1

(58) Field of Classification Search

CPC . H01R 24/64; H01R 13/6463; H01R 13/6658

USPC ..... 439/76.1, 676

See application file for complete search history.

(56) References Cited

U.S. PATENT DOCUMENTS

| | | | | | |
|---|---|---|---|---|---|
| 5,571,035 | A * | 11/1996 | Ferrill | 439/894 |
| 6,113,400 | A * | 9/2000 | Martin et al. | 439/76.1 |
| 6,123,572 | A * | 9/2000 | Ishii et al. | 439/465 |
| 6,157,542 | A * | 12/2000 | Wu | 361/752 |
| 6,238,235 | B1 * | 5/2001 | Shavit et al. | 439/418 |
| 6,250,949 | B1 * | 6/2001 | Lin | 439/418 |
| 6,267,617 | B1 * | 7/2001 | Nozick | 439/417 |
| 6,280,232 | B1 * | 8/2001 | Beecher et al. | 439/418 |
| 6,305,950 | B1 * | 10/2001 | Doorhy | 439/76.1 |
| 6,358,092 | B1 * | 3/2002 | Siemon et al. | 439/607.02 |
| 6,371,793 | B1 * | 4/2002 | Doorhy et al. | 439/404 |
| 6,379,175 | B1 * | 4/2002 | Reede | 439/418 |
| 6,402,559 | B1 * | 6/2002 | Marowsky et al. | 439/676 |
| 6,406,325 | B1 * | 6/2002 | Chen | 439/418 |
| 6,439,920 | B1 * | 8/2002 | Chen | 439/418 |
| 6,506,077 | B2 * | 1/2003 | Nagel | 439/607.05 |
| 6,520,807 | B2 * | 2/2003 | Winings | 439/676 |
| 6,524,128 | B2 * | 2/2003 | Marowsky et al. | 439/418 |
| 6,524,139 | B1 * | 2/2003 | Chang | 439/676 |
| 6,558,204 | B1 * | 5/2003 | Weatherley | 439/676 |
| 6,599,148 | B1 * | 7/2003 | Jensen et al. | 439/460 |
| 6,729,901 | B2 * | 5/2004 | Aekins | 439/418 |
| 6,769,937 | B1 * | 8/2004 | Roberts | 439/676 |
| 6,783,402 | B2 * | 8/2004 | Chen | 439/676 |
| 6,793,515 | B1 * | 9/2004 | Gwiazdowski et al. | 439/344 |

(Continued)

*Primary Examiner* — Ross Gushi

(74) *Attorney, Agent, or Firm* — Timothy M. Morella

(57) ABSTRACT

A guide member is provided for use with a multi-wire plug connector. It has an elongated body with multiple wire pathways extending through it in a torturous path so that wires inserted into one end of the guide member in a first orientation are twisted into a second orientation that is different than the first orientation. The guide member body is formed of two parts and one of the parts has ports for the injection of a settable compound, such as a hot melt adhesive to hold the guide member parts together as well as the wires in place within the guide member.

20 Claims, 10 Drawing Sheets

(56) References Cited

U.S. PATENT DOCUMENTS

| | | | | |
|---|---|---|---|---|
| 6,811,445 | B2 * | 11/2004 | Caveney et al. | 439/676 |
| 6,837,738 | B1 * | 1/2005 | Chen | 439/418 |
| 6,846,197 | B2 * | 1/2005 | Hirokawa et al. | 439/418 |
| 7,018,241 | B2 * | 3/2006 | Caveney et al. | 439/676 |
| 7,150,657 | B2 * | 12/2006 | Quenneville et al. | 439/676 |
| 7,175,468 | B1 * | 2/2007 | Chang | 439/418 |
| 7,182,649 | B2 * | 2/2007 | Caveney et al. | 439/676 |
| 7,220,149 | B2 * | 5/2007 | Pharney | 439/676 |
| 7,223,112 | B2 * | 5/2007 | AbuGhazaleh et al. | 439/344 |
| 7,229,309 | B2 * | 6/2007 | Carroll et al. | 439/418 |
| 7,249,962 | B2 * | 7/2007 | Milette et al. | 439/425 |
| 7,294,012 | B2 * | 11/2007 | AbuGhazaleh et al. | 439/418 |
| 7,335,066 | B2 * | 2/2008 | Carroll et al. | 439/676 |
| 7,425,159 | B2 * | 9/2008 | Lin | 439/676 |
| 7,513,787 | B2 * | 4/2009 | AbuGhazaleh et al. | 439/344 |
| 7,556,536 | B2 * | 7/2009 | Caveney et al. | 439/676 |
| 7,635,285 | B2 * | 12/2009 | Carroll et al. | 439/676 |
| 7,670,193 | B2 * | 3/2010 | Milette et al. | 439/676 |
| RE41,206 | E * | 4/2010 | Gwiazdowski et al. | 439/344 |
| 7,736,170 | B2 * | 6/2010 | AbuGhazaleh et al. | 439/344 |
| 7,883,376 | B2 * | 2/2011 | Milette et al. | 439/676 |
| 7,938,669 | B2 * | 5/2011 | Li et al. | 439/352 |
| 7,972,183 | B1 * | 7/2011 | Lin | 439/676 |
| 7,980,899 | B2 * | 7/2011 | Siemon et al. | 439/676 |
| 8,038,482 | B2 * | 10/2011 | Erickson et al. | 439/676 |
| 8,043,124 | B2 * | 10/2011 | Caveney et al. | 439/676 |
| 8,070,531 | B1 * | 12/2011 | Ku et al. | 439/676 |
| 8,137,141 | B2 * | 3/2012 | Straka et al. | 439/676 |
| 8,167,662 | B2 * | 5/2012 | Milette et al. | 439/676 |
| 8,235,757 | B2 * | 8/2012 | Brear | 439/676 |
| 8,251,730 | B2 * | 8/2012 | Wu | 439/345 |
| 8,272,902 | B2 * | 9/2012 | Straka et al. | 439/676 |
| 8,277,260 | B2 * | 10/2012 | Caveney et al. | 439/676 |
| 8,298,922 | B2 * | 10/2012 | Schumann et al. | 438/467 |
| 8,348,702 | B2 * | 1/2013 | Lin | 439/676 |
| 8,414,324 | B2 * | 4/2013 | Reed et al. | 439/345 |
| 8,439,704 | B2 * | 5/2013 | Reed | 439/607.06 |
| 8,475,198 | B2 * | 7/2013 | Wu | 439/352 |
| 8,647,146 | B2 * | 2/2014 | Bopp et al. | 439/404 |
| 8,684,763 | B2 * | 4/2014 | Mattson et al. | 439/460 |
| 8,690,598 | B2 * | 4/2014 | Bolouri-Saransar et al. | 439/404 |
| 8,702,453 | B2 * | 4/2014 | Caveney et al. | 439/676 |
| 8,770,990 | B2 * | 7/2014 | Sytsma et al. | 439/76.1 |
| 2002/0048990 | A1 * | 4/2002 | Marowsky et al. | 439/418 |
| 2002/0142644 | A1 * | 10/2002 | Aekins | 439/418 |
| 2003/0096529 | A1 * | 5/2003 | Brennan et al. | 439/418 |
| 2003/0157842 | A1 * | 8/2003 | Arnett et al. | 439/676 |
| 2003/0171024 | A1 * | 9/2003 | Mossner et al. | 439/404 |
| 2003/0199192 | A1 * | 10/2003 | Caveney et al. | 439/418 |
| 2003/0224666 | A1 * | 12/2003 | Yuan-Huei | 439/676 |
| 2004/0116081 | A1 * | 6/2004 | Crudele et al. | 455/115.1 |
| 2005/0037672 | A1 * | 2/2005 | Caveney et al. | 439/692 |
| 2005/0106929 | A1 * | 5/2005 | Meckley et al. | 439/418 |
| 2005/0136747 | A1 * | 6/2005 | Caveney et al. | 439/676 |
| 2005/0153603 | A1 * | 7/2005 | AbuGhazaleh et al. | 439/676 |
| 2006/0014410 | A1 * | 1/2006 | Caveney | 439/188 |
| 2006/0121788 | A1 * | 6/2006 | Pharney | 439/676 |
| 2006/0131056 | A1 * | 6/2006 | Hackman | 174/113 R |
| 2006/0160407 | A1 * | 7/2006 | Carroll et al. | 439/418 |
| 2006/0199434 | A1 * | 9/2006 | Chang | 439/610 |
| 2007/0167061 | A1 * | 7/2007 | AbuGhazaleh et al. | 439/344 |
| 2007/0202752 | A1 * | 8/2007 | Schumann et al. | 439/676 |
| 2008/0188138 | A1 * | 8/2008 | Carroll et al. | 439/676 |
| 2009/0142968 | A1 * | 6/2009 | Goodrich et al. | 439/676 |
| 2009/0239423 | A1 * | 9/2009 | Fitzpatrick et al. | 439/676 |
| 2010/0003863 | A1 * | 1/2010 | Siemon et al. | 439/676 |
| 2010/0015851 | A1 * | 1/2010 | Wu | 439/607.01 |
| 2010/0203754 | A1 * | 8/2010 | Li et al. | 439/345 |
| 2011/0059645 | A1 * | 3/2011 | Wu | 439/460 |
| 2011/0136368 | A1 * | 6/2011 | Wu | 439/345 |
| 2011/0195595 | A1 * | 8/2011 | Wu | 439/370 |
| 2011/0237112 | A1 * | 9/2011 | Wu | 439/358 |
| 2011/0250778 | A1 * | 10/2011 | Wu | 439/345 |
| 2011/0300749 | A1 * | 12/2011 | Sytsma et al. | 439/607.01 |
| 2011/0306244 | A1 * | 12/2011 | Zhang et al. | 439/624 |
| 2012/0100744 | A1 * | 4/2012 | Bolouri-Saransar et al. | 439/404 |
| 2012/0129396 | A1 * | 5/2012 | Wang et al. | 439/607.01 |
| 2012/0282818 | A1 * | 11/2012 | Caveney et al. | 439/676 |
| 2012/0329320 | A1 * | 12/2012 | Taylor et al. | 439/588 |
| 2013/0095676 | A1 * | 4/2013 | Wu | 439/76.1 |
| 2013/0210288 | A1 * | 8/2013 | Schumacher et al. | 439/676 |
| 2013/0210289 | A1 * | 8/2013 | Schumacher et al. | 439/676 |
| 2013/0225011 | A1 * | 8/2013 | Bopp et al. | 439/676 |
| 2013/0231011 | A1 * | 9/2013 | Sytsma et al. | 439/723 |
| 2014/0120779 | A1 * | 5/2014 | Lloyd et al. | 439/660 |
| 2014/0187077 | A1 * | 7/2014 | Bolouri-Saransar et al. | 439/404 |

* cited by examiner

FIG.4D
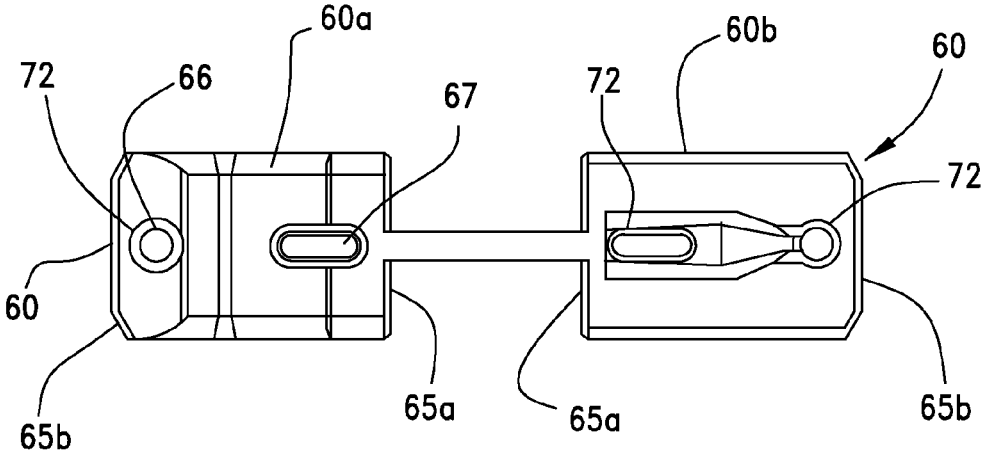
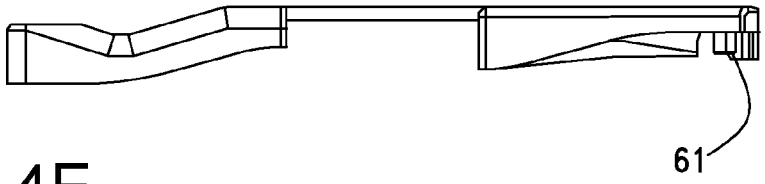
FIG.4E
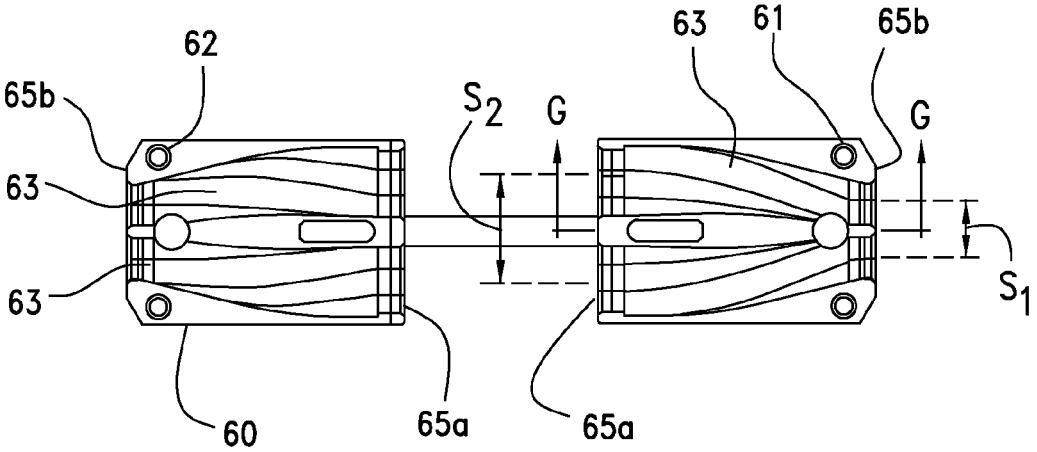
FIG.4F

SECTION Y-Y

FIG.6B
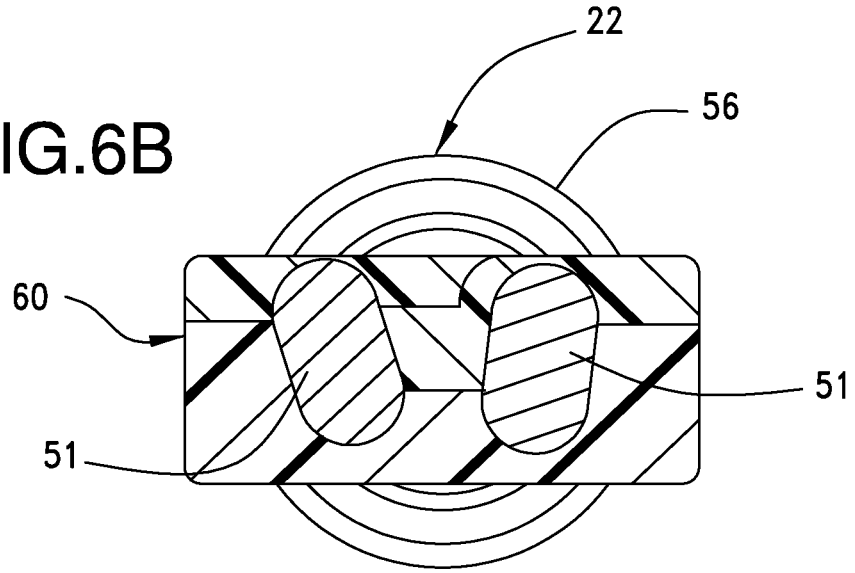
SECTION W-W
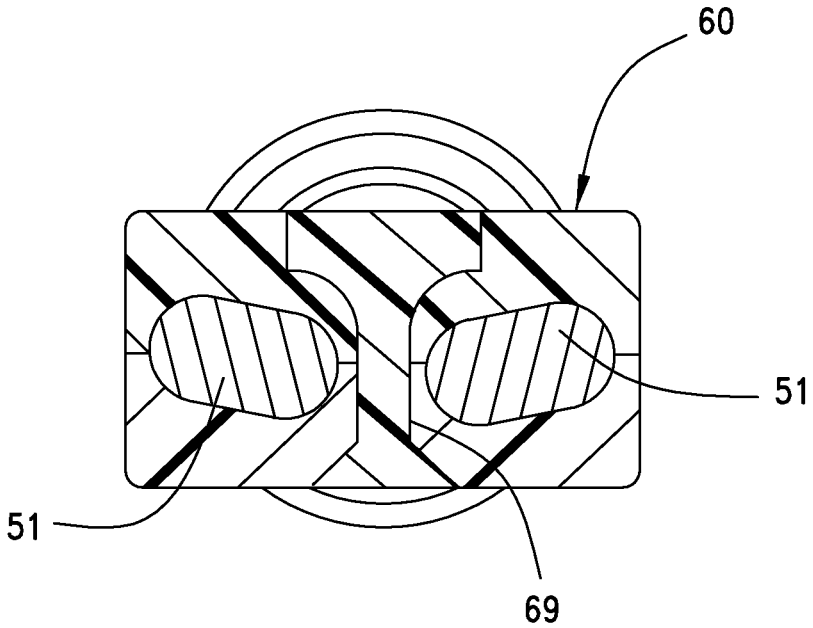
FIG.6C
SECTION X-X

CONNECTOR GUIDE FOR ORIENTING WIRES FOR TERMINATION

BACKGROUND OF THE PRESENT DISCLOSURE

The Present Disclosure relates generally to plug connectors, and more particularly to plug connectors with an improved wire termination aspect. The technology industry is ever growing and the need for more technology infrastructure, such as more routers and servers, exists in order to utilize internet access to its full capability.

Routers and servers and storage machines are interconnected by high speed connector assemblies in the form of cables having connectors, typically plug connectors, which are terminated to their ends. These connectors are designed for high speed data transmission and typically include a cable that holds a plurality of pairs of twin-axial wires. Twin-axial wires have two signal transmission wires that cooperatively transmit differential signals. A ground or drain wire is associated with each such pair and the twin-axial wires and a drain wire comprise each such signal transmission pair. The twin-axial wires are small and fragile and must be separated from the cable, termed "breakout" in preparation for termination. Care must be taken during termination of the twin-axial wires to the connectors so as not to bend, and consequently break the wires.

Furthermore, it is common to have the inner wires of the cable extend along a preselected length during termination which is unsupported. This requires the use of a jig specifically configured to provide support for the wires and to hold them in a desired orientation for their termination to the edge card of the connector. The need for specialized equipment also increases the cost of the connector and even with the jig, the wires are terminated to the edge card in an unsupported state and then a supporting plastic or other moldable material is injected around them and portions of the paddle card, after the termination of the cable wire pairs to the edge card. Hence, there presently appears not to be any reliable way of orienting and supporting the cable wires in a desirable orientation prior to the termination thereof to the connector edge card.

The Present Disclosure is directed to a structure that solves the aforementioned problems by providing a means to orient the cable wires, in sets or pairs in a generally horizontal orientation for termination to an edge card and for supporting the wires during termination in a manner so as to reduce the likelihood of damage to the wires of the wire joints as the wire conductors are soldered to the edge card.

SUMMARY OF THE PRESENT DISCLOSURE

In one aspect, the Present Disclosure describes a guide member that orients the cable wire pairs from a vertical orientation to a horizontal orientation where the signal wires of the sets are arranged in a generally horizontal pattern and are fixed in place to provided strain relief to the wires during the termination thereof. In another aspect, the guide member includes structure that captures the wires and supports them in a reliable and steady orientation so as to provide a discrete mass enclosing portions of the wires that may be easily manipulated during attachment of the wires to the edge card and that facilitates handling of the breakout portion of the cable.

A guide member in accordance with the principles of the Present Disclosure includes a body portion that is formed of two halves. The halves are preferably interengaging elements that have at least two wire paths that are cooperatively defined when the halves are assembled together. The wire paths are twisted in their orientation, meaning they are aligned together with a first axis at one end of thereof and they are aligned together with a second axis, different than the first axis at the other end thereof. The interior walls of the guide member parts are fashioned so that the guide member parts may be placed into a holder and a cable wire pair inserted therein and pushed therethrough. As the cable wire pairs travel the length of the wire paths, they contact the walls of the wire paths and are twisted in their orientation so that the free ends of the wire pairs are oriented along the second axis.

The wire pairs have twisting walls that serve to re-orient the wire pairs from a generally vertical (first) orientation to a generally horizontal (second) orientation. In order to ensure the integrity of the guide member, the guide member, the guide member halves are preferably provided with a plurality of ports that mate together and which provide injection points into which a settable material is injected. The material of choice, at present, is a hot melt adhesive which can be injected at low pressures to reduce any likelihood that crushing of the cable wire pairs will result. Alternatively, the guide member halves may be riveted, screwed, press-fit or welded together, or combined in any other fashion. One port at least communicates with the interior of the guide members, and specifically the wire paths thereof and defines a pathway through the guide member which the molding material may spread through the guide member into contact with the guide member and the cable wire pairs to form a unitary structure once the hot melt adhesive has set. The other port preferably has a non-uniform configuration that serves to define a locking plug of hot melt and which also communicates with the one port so that the hot melt need only be injected into the guide member at the one port.

The guide member preferably has a length that extends from the breakout of the cable free end to just adjacent the tail end of the edge card so that the cable wire pairs are fully supported in that specific extent. The wires of the cable pairs are thus oriented generally horizontally at their forward ends with the guide member in place, and can be more easily applied to contact pads on the edge card and soldered thereto without the twisting and bending that accompanied the cable wires as terminated in the prior art. The unitary guide member provides a measure of stress relief to the cable wire pairs and can easily be molded with an exterior configuration that facilitates its insertion into a connector housing.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 4D is a top plane view of the guide member of FIG. 4A;

FIG. 4E is a side elevational view of the guide member of FIG. 4D;

FIG. 4F is a bottom plane view of the guide member of FIG. 4A;

FIG. 6B is a transverse cross-sectional view of the guide member portion of the cable breakout assembly of FIG. 6, taken along Lines W-W thereof; and FIG. 6C is a transverse cross-sectional view of the guide member portion of the cable breakout assembly of FIG. 6, taken along Lines X-X thereof

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
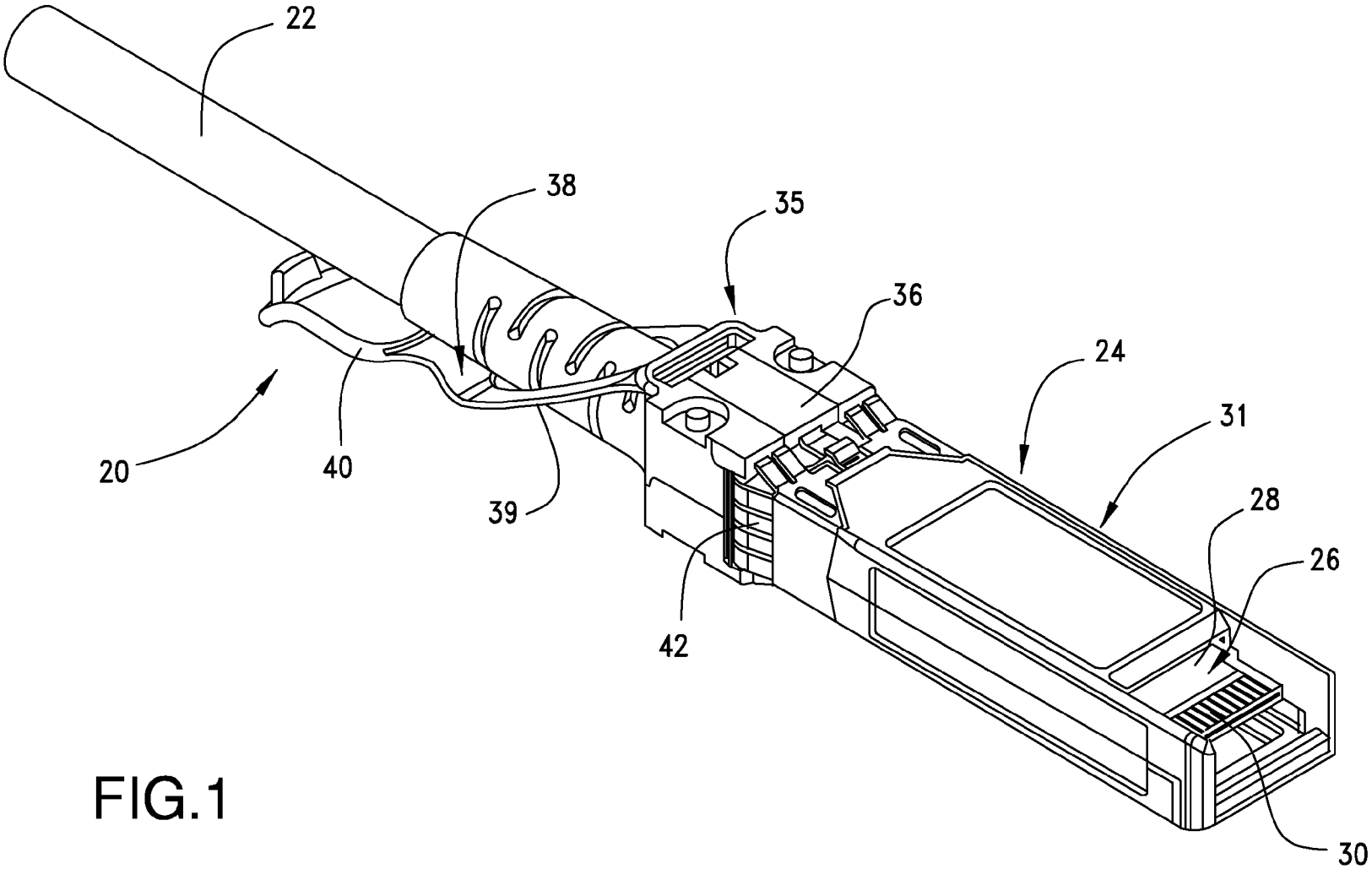
FIG. 1 is a perspective view of a plug connector incorporating the principles of the Present Disclosure.

FIG. 1 is a perspective view of a plug connector assembly 20 constructed in accordance with the principles of the Present Disclosure. The connector assembly 20 include a multi-wire cable 22 that is terminated to a plug connector 24, which has a mating blade 26 defined by a circuit card 28 that has an array of contacts, or contact pads, 30 that are arranged along a forward, mating edge 29 thereof. The plug connector 24 has an exterior housing 31 that is configured to be received within a receptacle of an electronic device (not shown). The housing may be assembled from two halves 31*a*, 31*b* as shown or it may be formed as a unitary member. The housing 31 has a hollow interior 32 that receives the open end of the cable 22 as well as the circuit card 28, which may be supported therein on shoulders 33 defined within the housing 31 and along the inner sides of the housing halves 31*a*, 31*b*.

Figure 2A:
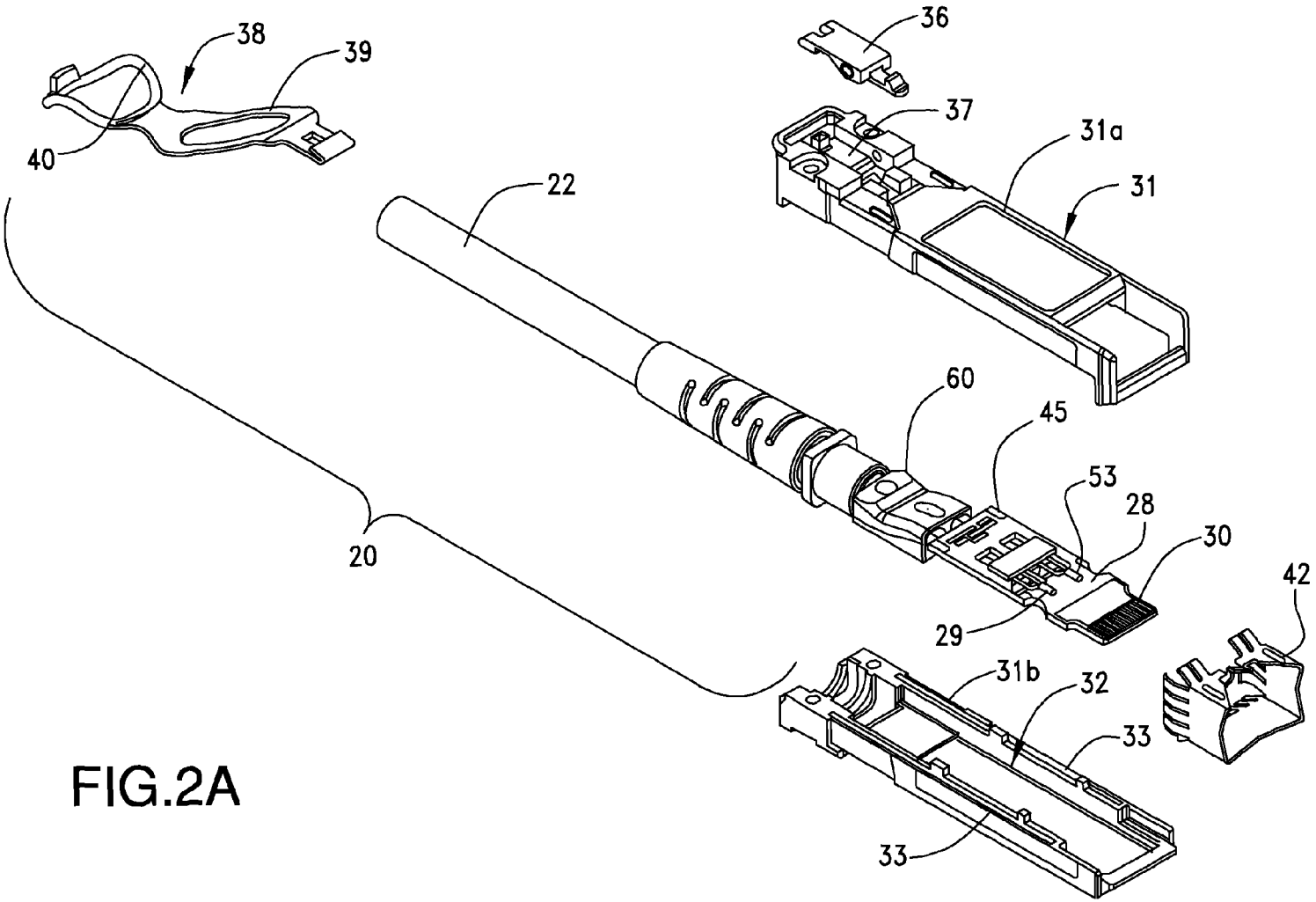
FIG. 2A is an exploded view of the plug connector of FIG. 1.

The housing 31 may further be provided with a latching assembly 35 that selectively engages and disengages the electronic device to which it is mated. The latching assembly may include, as illustrated best in FIG. 2A, a moveable latching member 36 that is received within a cavity 37 of the housing 31. An actuator 38 is provided that fits over the cable 22 by way of a loop 39 and has a finger loop 40 by which a user can grasp the actuator 38 and pull on it in order to disengage the latch member 36 from the device. A metal shielding collar 42 is also present on the exterior of the plug connector 24 to provide EMI shielding at the location where the plug connector will meet the opening of the receptacle of the electronic device.

The circuit card 28 includes circuits that extend between the opposite ends of the card 28 and which are terminated to contact pads. Such a circuit card 28 is referred to in the art as either an edge card or a paddle card and those two terms are used in this description interchangeably. The forward contact pads 30 are ones that make contact with opposing electrical contacts of a receptacle connector of the electronic device while the rear contact pads 29 are located rearwardly of the front contact pads 30 and may or may not be disposed proximate the rear edge 45 of the paddle card 28. The rear contact pads 29 provide termination locations for the cable wire pair conductors 54. The cable 22 has an exterior, insulative housing 50 that encloses a plurality of wires which are arranged in sets 51 that comprise two signal transmission wires 52 and a ground, or drain wire 53 such that the sets, or pairs, define signal transmission lines that are suitable for transmitting differential signals. Each such wire set comprises a wire pair 51, which is known in the art as a twin-axial cable, or pair. The wire pairs 51 each include two signal wires 52 and an associated ground or drain wire 52. The signal wires may be separately formed with center conductors 54 enclosed within separate, associated insulative coverings 55, or the two conductors 55 of each wire pair 51 may be enclosed within a single insulative covering. The drain wire 53 may or may not be covered with an insulative coating. Most commonly, it is not.

The wire pairs 51 are enclosed within an outer grounding sheath 56 which may be a braided, hollow sheath or a copper foil tube. Typically, these twin-axial wire pairs 51 are arranged in a vertical orientation with in the cable 22. In order to terminate the signal and drain wires to the paddle card 28, a "breakout" is formed, meaning the cable 22 is cut to form a free end, and the cable grounding sheath 56 is pulled back over a certain length of the cable free end for contacting the plug connector housing 31. This cable breakout is shown, for example, in FIG. 4A. The cable outer insulative covering 50 is cut back so as to expose a preselected length L of the wire pairs 51 and drain wires 53. These signal and drain wires 52, 53 are small and fragile and are susceptible to breaking under excessive and/or rough handling. These wires 52, 53 are often bent when handled and the ends are easily stubbed and or broken. Additionally there is an intervening space 44 through which the wire pairs 51 extend between the breakout from the cable 22 and the tail end 45 of the paddle card 28. The plug connector assemblies 20 are subject, at times, to repeated insertion and removal from their associated devices. With such movement, comes repeated bending in this intervening area 44, thereby putting stress on the wire pairs 51 and the soldered joints that attach the conductors of the signal and drain wires 52, 53 to the paddle card 28.

Figure 2B:
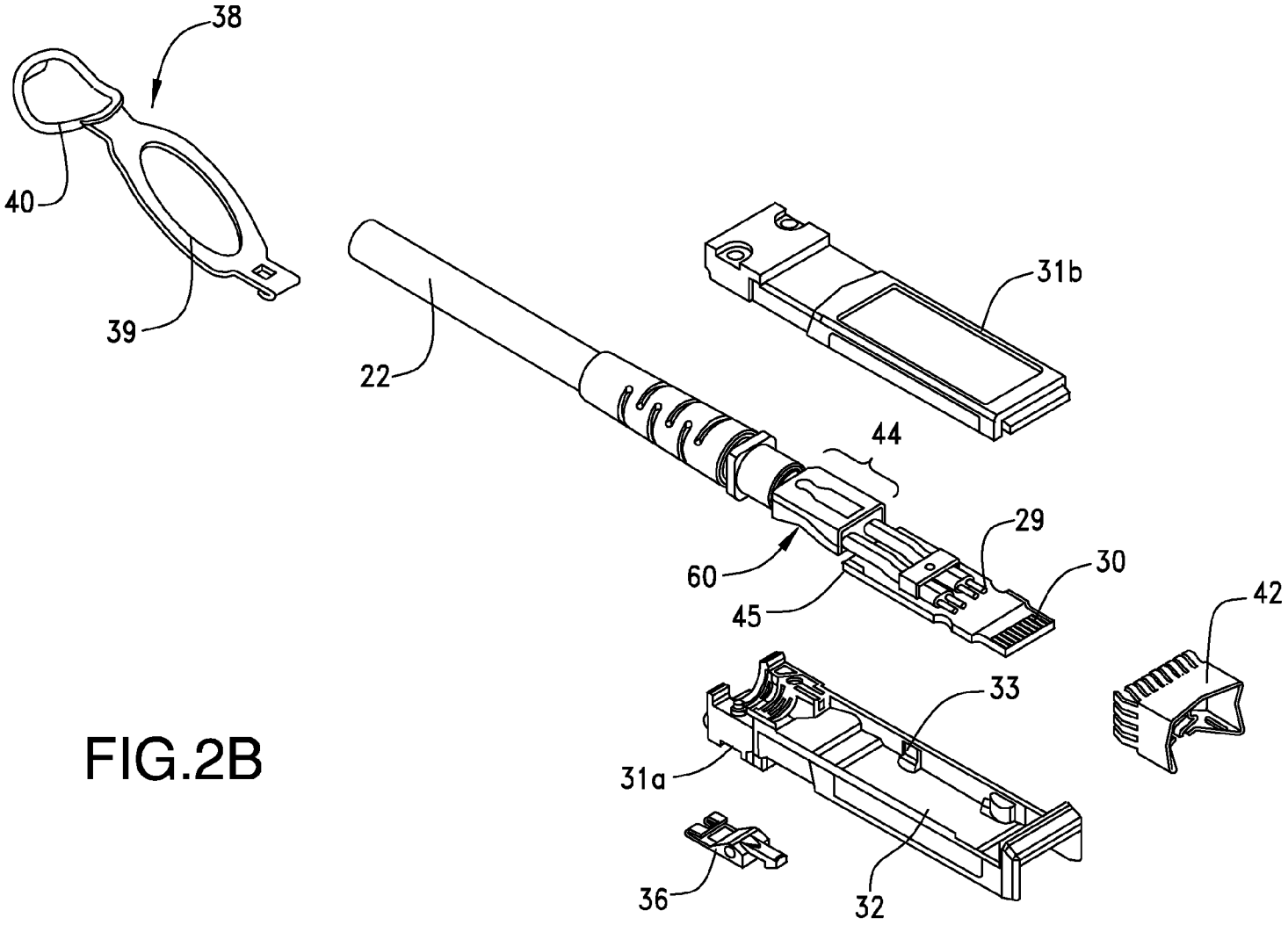
FIG. 2B is the same view as FIG. 2A but taken from the bottom side thereof to illustrate the other side of connector paddle card and the cable wires terminated thereto.
Figure 3A:
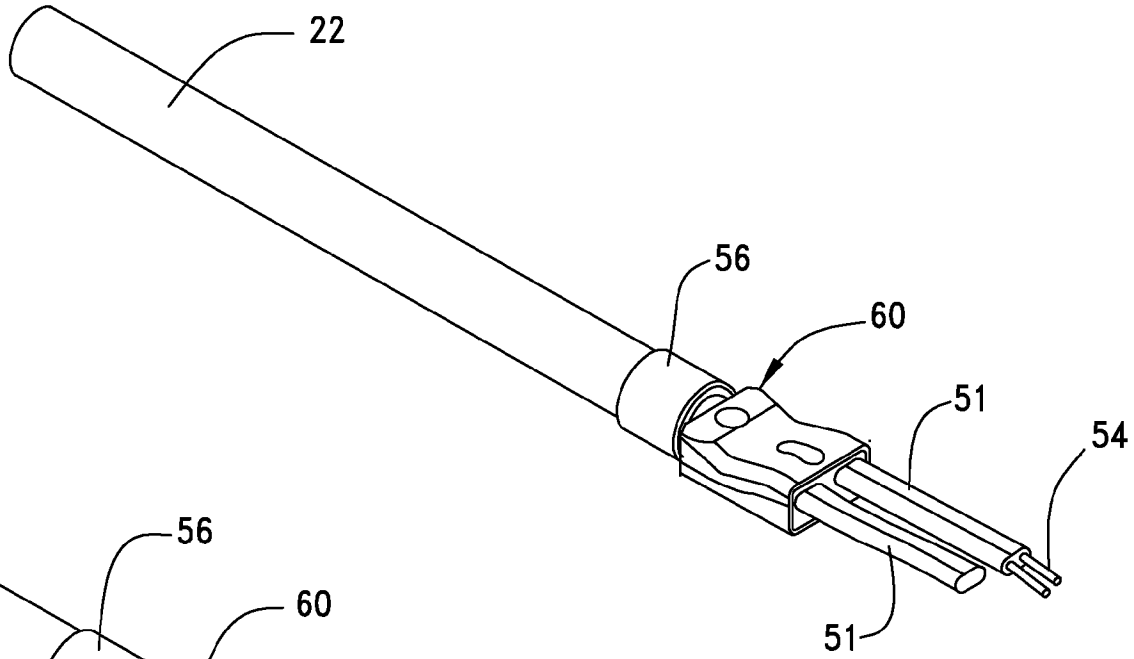
FIG. 3A is a top, perspective view of the cable of the plug connector of FIG. 1, with its inner twin-axial wires held in place by a guide member of the Present Disclosure.
Figure 3B:
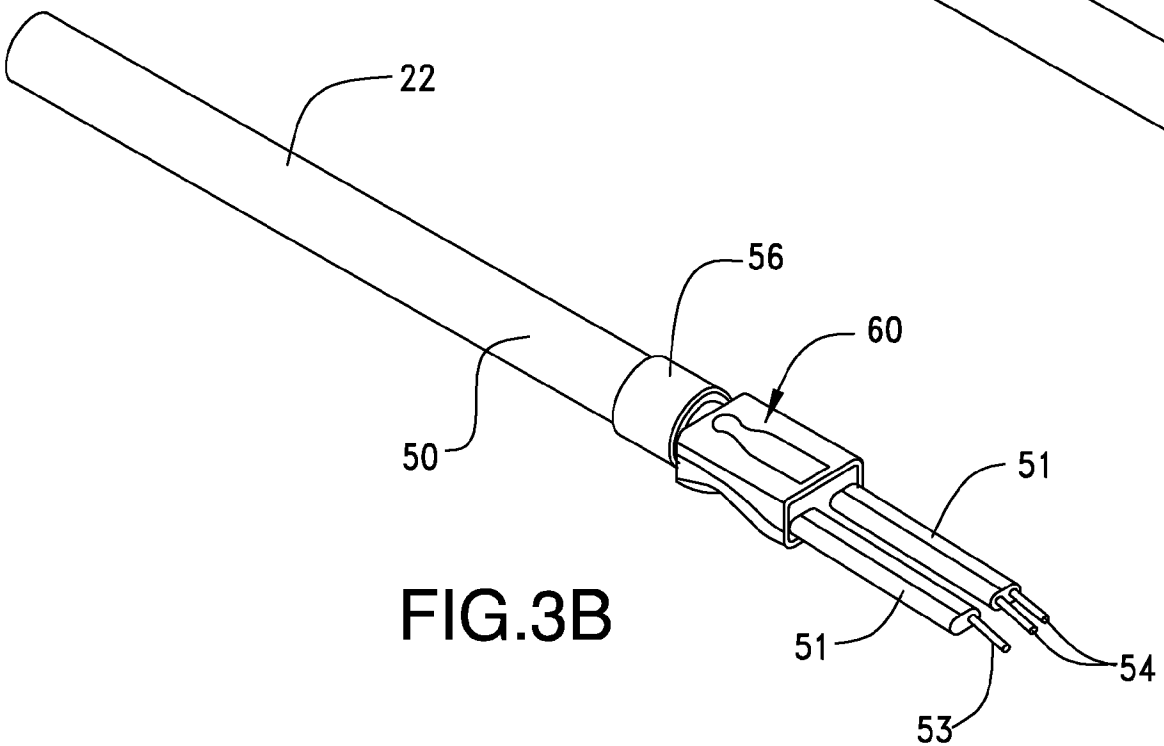
FIG. 3B is the same view as FIG. 3A but inverted so as to illustrate the bottom of the guide member.

The Present Disclosure is directed to a solution to this problem that reinforces the breakout area and which aligns the wires at minimal cost in both material and labor. A guide member 60 in accordance with the Present Disclosure is shown in FIG. 2B as extending in the space 44 between the breakout end, that is, the free end of the cable where the inner wire pairs 51 are exposed, and the tail end 45 of the paddle card 28. Normally this area remains open or is filled with a solid material after the termination of the cable wire pairs 51 to the paddle card contact pads 29. In the Present Disclosure, the guide member 60, as illustrated in FIGS. 3A and 3B is applied to the exposed portions of the cable wire pairs 51 and forms a unitary structure that holds the cable wire pairs in a preferred orientation, i.e, generally horizontally, and which provides a solid block that may be held either manually or as within a jig to hold the cable pair wire ends in place for attachment to the paddle card 28, such as by soldering.

Figure 4A:
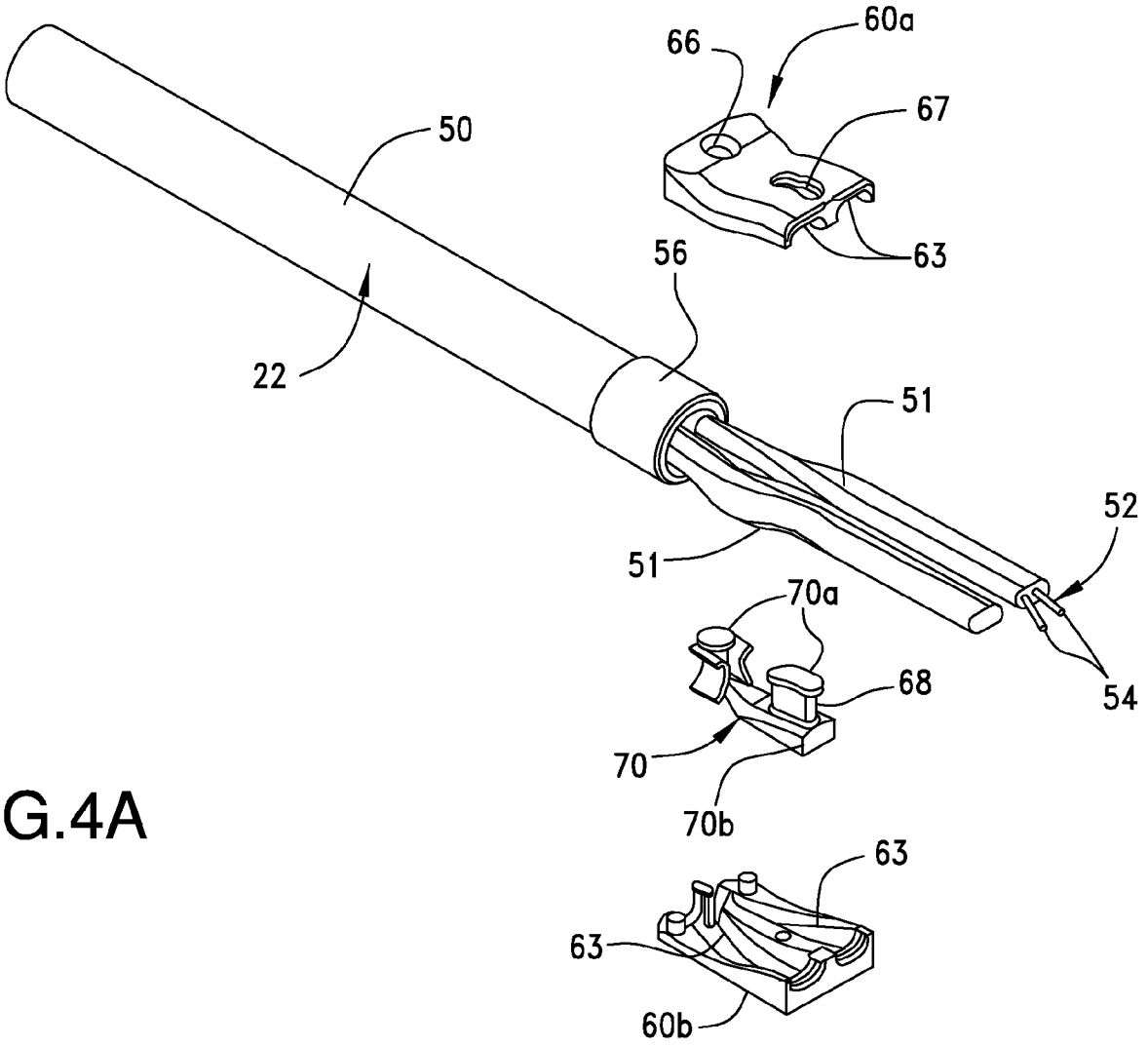
FIG. 4A is an exploded view of the cable end breakout and the guide member, similar to FIG. 3A.
Figure 4C:
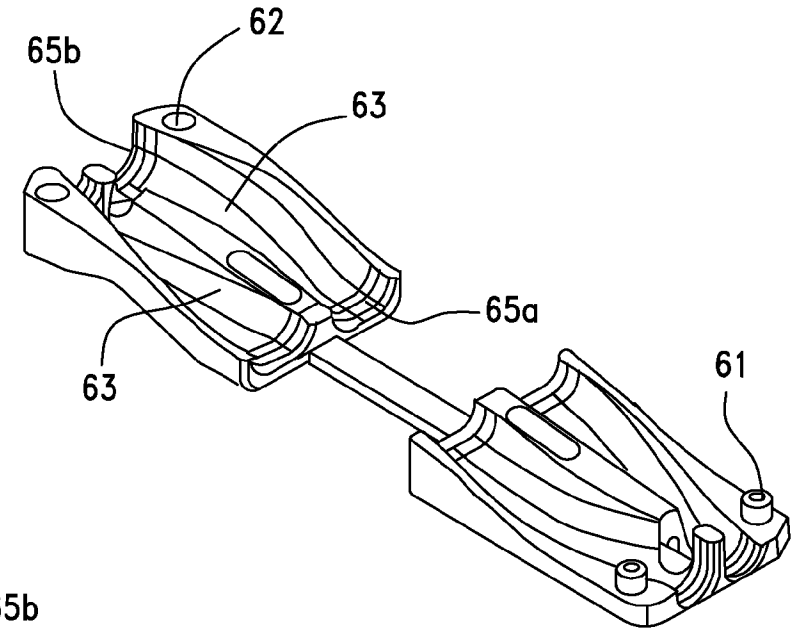
FIG. 4C is the same view as FIG. 4B, but illustrating the underside thereof.

The guide member 60, as shown best in FIG. 4A, is preferably formed from two parts 60*a*, 60*b* that mate together. It is preferred that the two parts interengage each other utilizing structure known in the art such as posts 61 and complementary-shaped holes 62 (FIG. 4C.) The two guide member parts, or halves 60*a*, 60*b* have a plurality of hollow guide paths 63 defined therein that extend lengthwise between the opposite ends 64*a*, 64*b* of the guide member 70. Each of these guide paths is configured to receive a single twin-axial wire pair 51 from the cable 22 in a manner such that the wire pair 51 may be inserted from one end, the rear, or tail end 65*b* as shown in FIGS. 3A & 3B and pushed through the guide member 60 so that the free end of the wire pair 51 exits the other, or front end 65*a*, of the guide member 60.

Figure 6:
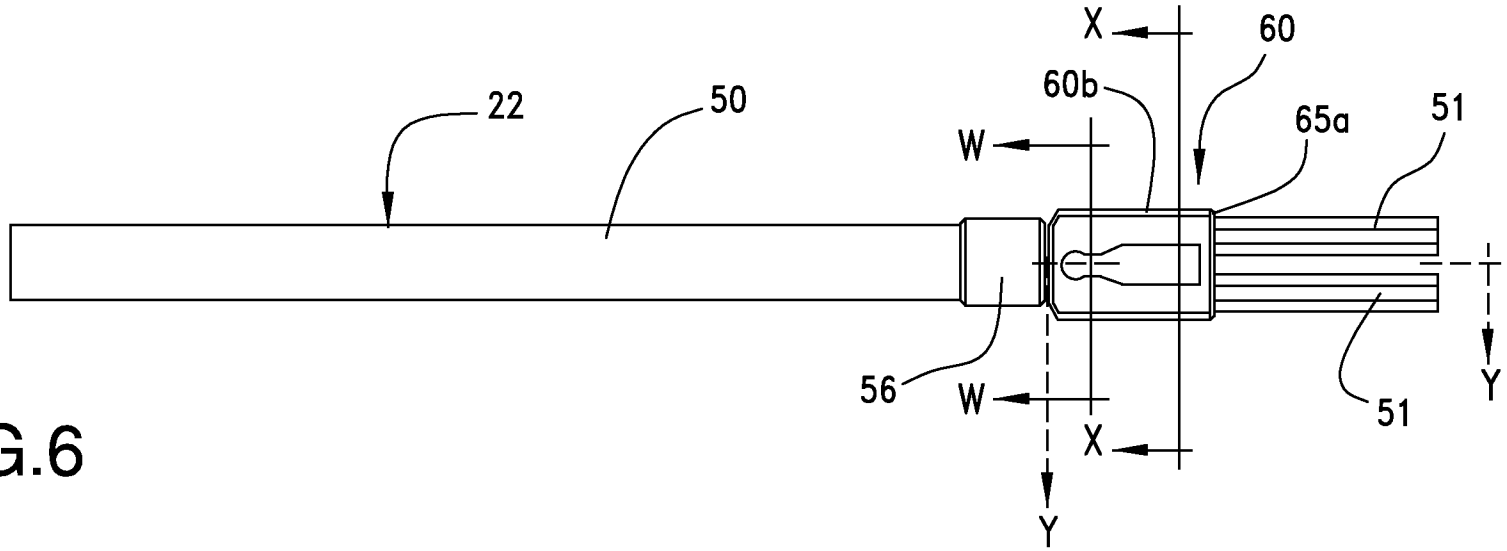
FIG. 6 is a bottom plan view of the cable breakout assembly illustrated in in FIG. 5.

The wire pairs 51 of the cable 22 have a generally vertical orientation at the cable breakout area and as such, are preferably aligned with each other on opposite sides of an intervening vertical axis (FIG. 6B.) The guide paths 63 are not linear but, rather, are twisted, or what may be considered as defining a torturous path through the guide member 60 so that the orientation of the wire pairs 51 are changed from one end of the guide member 60 to the other end. This change, as shown in the drawings, is from the general vertical orientation at the tail end 65*b* of the guide member 60 to a generally horizontal orientation at the forward, or leading end, 65*a* of the guide member 60. This orientation change also may be considered as a rotation of the wire pairs aorund a longitudinal axis thereof. Such rotation is approximately 90 degrees (plus or minus 10 degrees for tolerance) so that the wire pairs 51 are arranged in generally horizontally alignment as they exit the guide member 60. In this manner, the wire pairs may be easily manipulated into place in contact with the paddle card rear contact pads 29 by grasping the guide member either manually or with a device.

In order to maintain the impedance of the wire pairs 51 at a desired level, the guide paths 63 are preferably mirror images of each other, or are symmetrical with respect to an intervening longitudinal axis G-G, as shown best in FIG. 4F. In this manner, the conductors 54 of each wire pair 51 are maintained at approximately a desired spacing. As the wire pairs 51 enter the guide member guide paths 63 at the guide member tail end 65*b* they are horizontally oriented at a given center-to-center spacing S1 and as they are twisted into a horizontal orientation at the guide member front end 65*a*, the spacing increases to S2 (FIG. 4F.) This increase in spacing is approximately uniform between the wire pairs, which serves to maintain the reduction in capacitance between the wire pairs 52 which occurs as the intervening spacing increases at a constant rate, equal to the degree of turn that occurs in the wire per unit length of the guide member. Without this symmetry, the change in impedance between the two wire pairs would be non-uniform and erratic and subject to inducing interference during high speed data transmission.

Figure 4B:
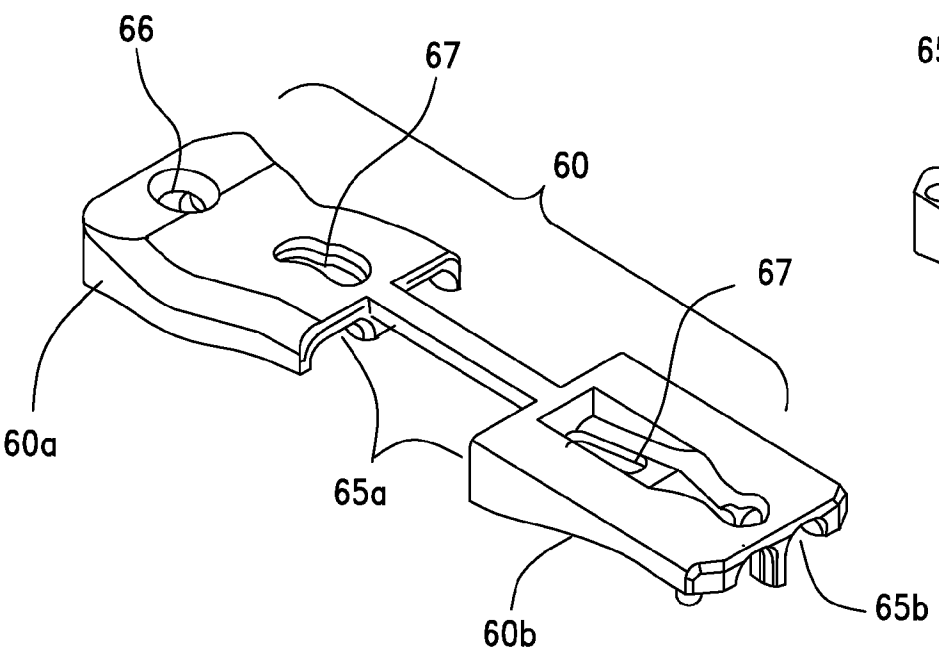
FIG. 4B is a perspective view of a guide member formed in accordance with the principles of the Present Disclosure and utilized in the connector assembly illustrated in FIG. 2A.
Figure 6A:
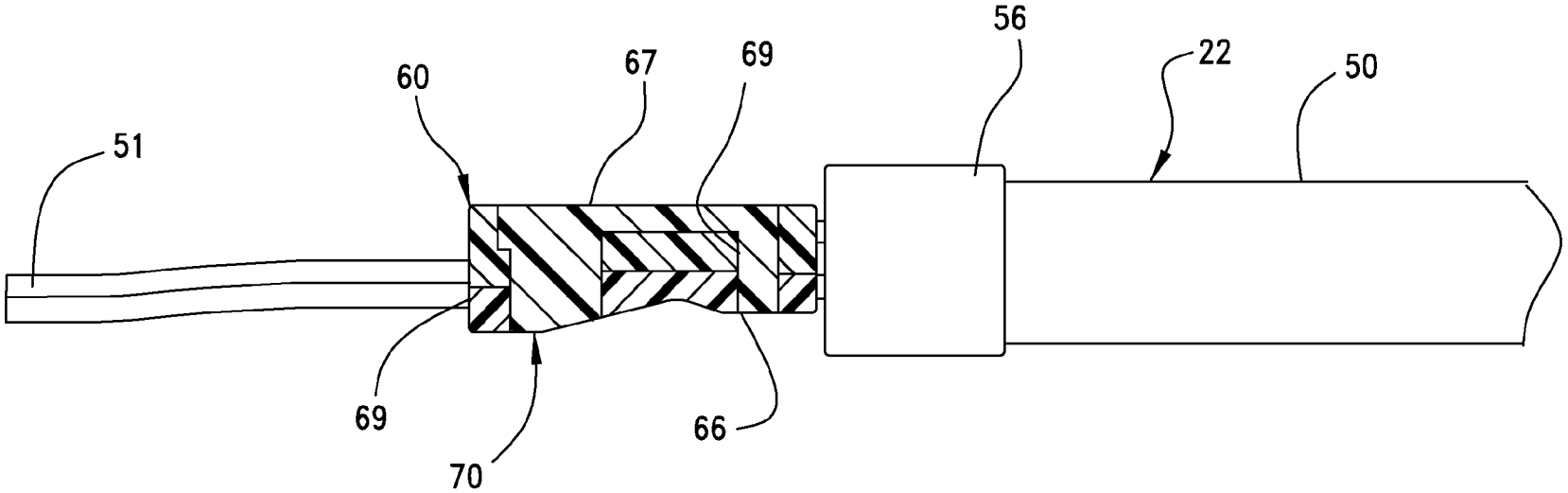
FIG. 6A is a longitudinal cross-sectional view of the guide member portion of the cable breakout assembly of FIG. 6, taken along Lines Y-Y thereof.

In order to hold the guide member halves, or parts 60*a*, 60*b*, one or more injection opening, or ports 66, 67 are provided. One such port 66 is generally circular in configuration while the other port 67 is non-circular and is illustrated in the Drawings as having a keyhole configuration. Both ports 66, 67 have cavities that are configured to have larger end portions 68*a*, 68*b* than the intermediate portion 69 that interconnects the ends so that when a settable material is injected into the ports, one or more retaining plugs 70 are formed. In the Drawings, particularly FIG. 6A, the plug 70 is seen to extend through both ports 66, 67 and has two intermediate sections 68 are formed that are interconnected to the larger end portions 70*a*, 70*b*. This plug serves to hold the guide member halves 60*a*, 60*b* together. The wire guide paths 63 are slightly larger than the wire pairs 51 which they accommodate and at least one fo the ports communicates with the guide paths 63 in manner such that when the hot melt is injected into the guide member 60, the hot melt also flows into the guide paths and into contact with the walls thereof and the wire pairs 51. This enlargement is easily accomplished by chamfering the sidewalls of the port as shown at 72 in FIG. 4B.

Figure 5:
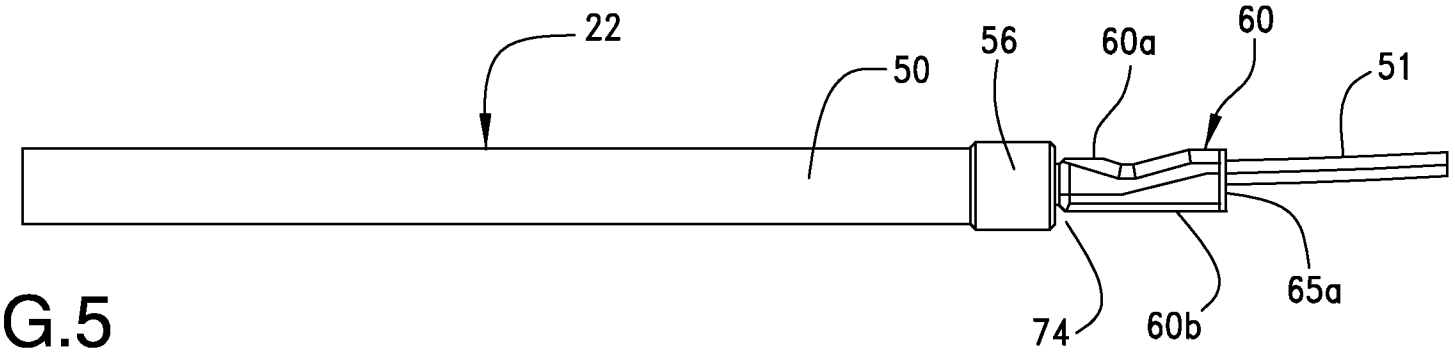
FIG. 5 is a side elevational view of the cable and guide member attached thereto in the breakout area as illustrated in FIG. 3A.

This construction forms a unitary structure that can be more easily handled and manipulated, and which reduces the likelihood of bending or breaking the signal and drain wires or their respective conductors. The exterior configuration of the guide member may be chosen so that it is complementary to the interior 32 of the connector 24 so as to facilitate the insertion of it and the attached paddle card 28 into the connector housing 31. Also, the guide member guide paths 63 may change their elevation relative to the opposite ends of the guide member 60 as the wire guide paths 63 traverse the guide member 60 from end to end 65*a*, 65*b*. As shown in FIG. 5, this creates a space 74 beneath the wire pairs 51 in their exiting horizontal orientation which can accommodate a portion of the paddle card therein (FIG. 2B.)

While a preferred embodiment of the Present Disclosure is shown and described, it is envisioned that those skilled in the art may devise various modifications without departing from the spirit and scope of the foregoing Description and the appended Claims.

What is claimed is:

1. A plug connector assembly, the plug assembly comprising:

a cable, the cable including an insulative exterior covering and a plurality of wires arranged in pairs, the pairs extending through a breakout area at an open end of the cable and being disposed in a first orientation proximate the open end;

a plug body portion, the plug body portion including a mating end, a trailing end and a circuit card, the mating end being configured to engage an opposing mating connector, the trailing end being configured to receive the wire pairs of the cable plurality of wires from said cable, the conductors of the wire pairs being terminated to the circuit card; and a guide member, the guide member guiding the wire pairs therethrough and changing their orientation from the first orientation to a second orientation proximate the circuit card, the second orientation being different than the first orientation, the guide member including two halves.

2. The plug connector assembly of claim 1, wherein in the first orientation, the wire pairs are aligned with a vertical axis of the cable, and in the second orientation, the wire pairs are aligned with a horizontal axis of the circuit card.

3. The plug connector assembly of claim 1, wherein in the first orientation, the wire pairs are generally vertical, and in the second orientation, the wire pairs are generally horizontal.

4. The plug connector assembly of claim 1, wherein the guide member includes at least two wire guide paths, each wire path being configured to receive one wire pair therein, the two wire guide paths extending in non-linear paths through the guide member.

5. The plug connector assembly of claim 1, wherein and the guide member halves are held together at least in part by an adhesive.

6. The plug connector assembly of claim 1, wherein the guide member halves are held together by an affixing means, the affixing means consisting of rivets and screws.

7. The plug connector assembly of claim 1, wherein the guide member halves are welded together.

8. The plug connector assembly of claim 1, wherein the guide member halves are press fit together.

9. The plug connector assembly of claim 1, wherein the cable include two wire pairs and the guide member includes two wire guide paths extending between opposite ends thereof.

10. The plug connector assembly of claim 9, wherein the wire paths define tortorous paths that twist the wire pairs approximately 90 degrees between the first and second orientations.

11. The plug connector assembly of claim 9, wherein the guide member further includes at least two ports extending between the guide member halves, the ports being configured to a cavity that receives a settable material, the settable material defining at least one plug that holds the guide member halves together.

12. The plug connector assembly of claim 11, wherein each port has a different configuration.

13. The plug connector assembly of claim 11, wherein the settable material is a hot melt adhesive and each plug has two enlarged end portions at opposite ends thereof interconnected by a smaller intermediate portion.

14. The plug connector assembly of claim 11, wherein each port communicates with the wire guide paths such that the hot melt adhesive contacts walls of the wire guide paths and the wire pairs.

15. The plug connector assembly of claim 9, wherein the wire guide paths are symmetrical with each other with respect to an intervening axis of the guide member such that the wire pairs are maintained in place within the guide member in a preselected spacing.

16. The plug connector assembly of claim 15, wherein the preselected spacing is nonlinear and increases from one end of the guide member to the the guide member opposite end.

17. A plug connector, the plug connector comprising:

a cable, the cable including an insulative exterior covering and a plurality of wire pairs, the wire pairs extending through the covering and exiting from the cable at a breakout area defined at an open end of the cable, the wire pairs being generally vertical aligned with each other proximate the open end;

a plug connector, the plug connector being disposed proximate the open end, the plug connector including a mating end, a trailing end and a circuit card therewithin, the mating end being configured to engage an opposing mating connector, the trailing end being configured to receive the wire pairs of the cable plurality of wires from the cable, conductors of the wire pairs being terminated to the circuit card; and a guide member, the guide member being interposed between a rear edge of the circuit card and the open end, the guide member including an elongated body having at least two wire guide paths defined therein, each wire guide path receiving a wire pair therein, the guide paths having a nonlinear extent through the guide member which such that the wire pairs are generally horizontally aligned with each other proximate the circuit card rear end, the guide member including two halves.

18. The plug connector of claim 17, wherein the guide paths rotate the wire pairs through a preselected extent around a longitudinal axis of the wire pair from a rear end of the guide member to a front end of the guide member.

19. The plug connector of claim 18, wherein the rotation is approximately 90 degrees.

20. The plug connector of claim 17, further including a plug formed from an injectable settable material that contacts the the guide member and wire pairs and forms a unitary structure around the wire pairs.

* * * * *